US006715209B2

(12) United States Patent
Taylor et al.

(10) Patent No.: US 6,715,209 B2
(45) Date of Patent: Apr. 6, 2004

(54) FOLDING TOOL

(75) Inventors: Stewart Taylor, Kingsport, TN (US); Robert E. Pearman, Gray, TN (US)

(73) Assignee: Taylor Cutlery, LLC, Kingsport, TN (US)

( * ) Notice: Subject to any disclaimer, the term of this patent is extended or adjusted under 35 U.S.C. 154(b) by 0 days.

(21) Appl. No.: 10/108,641

(22) Filed: Mar. 29, 2002

(65) Prior Publication Data

US 2003/0182803 A1 Oct. 2, 2003

(51) Int. Cl.[7] ..... B26B 1/02
(52) U.S. Cl. ..... 30/155; 30/161
(58) Field of Search ..... 30/340, 155–161, 30/144, 331, 143; 7/118–120

(56) References Cited

U.S. PATENT DOCUMENTS 1,086,152 A * 2/1914 Fuller ..... 30/155
D154,482 S * 7/1949 Hill ..... 30/155

* cited by examiner

*Primary Examiner*—Douglas D. Watts
(74) *Attorney, Agent, or Firm*—Stevens, Davis, Miller & Mosher, LLP

(57) ABSTRACT

A folding cutting tool which includes a handle having gripping depressions and a plurality of cutting blades. The blades are rotably connected to the ends of the handle to allow them to be folded into the handle or extend from the handle during operation of the tool. At least one blade has at least one depression that aligns with a depression on the handle. Alternatively, the blades of the tool may fold far enough into the handle to not interfere with the depressions in the handle. The depressions allow for the user to adequately grip the handle to perform a cutting operation.

22 Claims, 4 Drawing Sheets

FOLDING TOOL

FIELD OF INVENTION

The invention relates to a folding tool having an improved gripping structure allowing better handling while the user operates the tool.

BACKGROUND OF INVENTION

Various knife and folding saws exist on the market. Most such saws are of a one blade design wherein a handle and a knife blade are pivotally connected at an end of each. The knife blade rotates with respect to the handle which allows it to fold into the interior of the handle through an aperture on an upper side of the handle or extend in a direction continuous with the contour of the handle where it is locked into place for use.

Many of such knifes have a handle design consisting of depressions along the upper side of the handle allowing the user to grip the knife handle firmly while the blade is extended and in use. Other knife or saw designs consist of a handle and at least a pair of knife or saw blades either connected on the same side of the handle or connected at opposite ends of the handle. Generally, when one blade is extended for use, the other remains inside the handle. This is to prevent the unused blade from interfering with the use of the extended blade and from injuring the user.

A draw back to the dual blade design or multiple blade design is that the back sides of the blade or blades not in the closed position protrude from the handle. Conventional multiple folding knives do not have depressions in the upper side of the handles. Even if such knives contained these depressions, the depressions would be prevented from use when the blade not in use is folding into the handle. The back side of the blade would prevent the fingers of the user from gripping the handle in the depressions. This means that during a strong cutting action by the user, the knife is not gripped as strongly as may be needed.

SUMMARY OF INVENTION

An object of invention is to overcome the gripping problems mentioned above when such is needed in a dual blade knife or saw. This object is achieved by providing a folding saw having at least a pair of blades that fold from the ends of a handle having a plurality of depressions. The blades not in use either fold sufficiently into the handle or the heels of the knife blades themselves have depressions the correspond to those of the handle to allow access of the user's fingers to the handle depressions which provides a stronger grip of the saw or knife.

In such a design the handle has an elongated shape having an aperture along an upper side to accept knife blades not being used and folded into the handle. This upper side of the handle having a plurality of depressions to allows the user to firmly grip the handle. There may be one depression, a group of depressions or there may be several along the entire upper side of the handle. Such a design also has a plurality of blades that may be pivotally attached to the handle at a single end, at opposite ends or combinations thereof. There may be a pair of blades or any greater number that can achieve the same result. The blades may fold deeply into the handle to allow for the user's fingers to fit into the depressions. Alternatively, the back side of the blades may have one or a plurality of depressions that align with the depressions on the handle to allow the user's fingers to fit into the depressions. Both designs will aid the user in gripping the handle firmly to perform a cutting action using the saw or knife.

BRIEF DESCRIPTIONS OF THE DRAWINGS

DETAILED DESCRIPTION OF THE PREFERRED EMBODIMENTS

Figure 1:
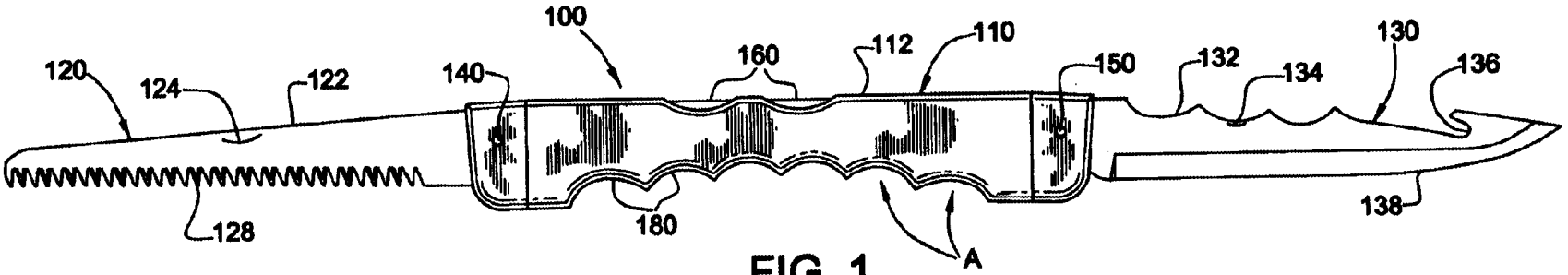
FIG. 1 is a perspective view of a first embodiment of the invention showing the blades in the closed position and the open position.
Figure 2:
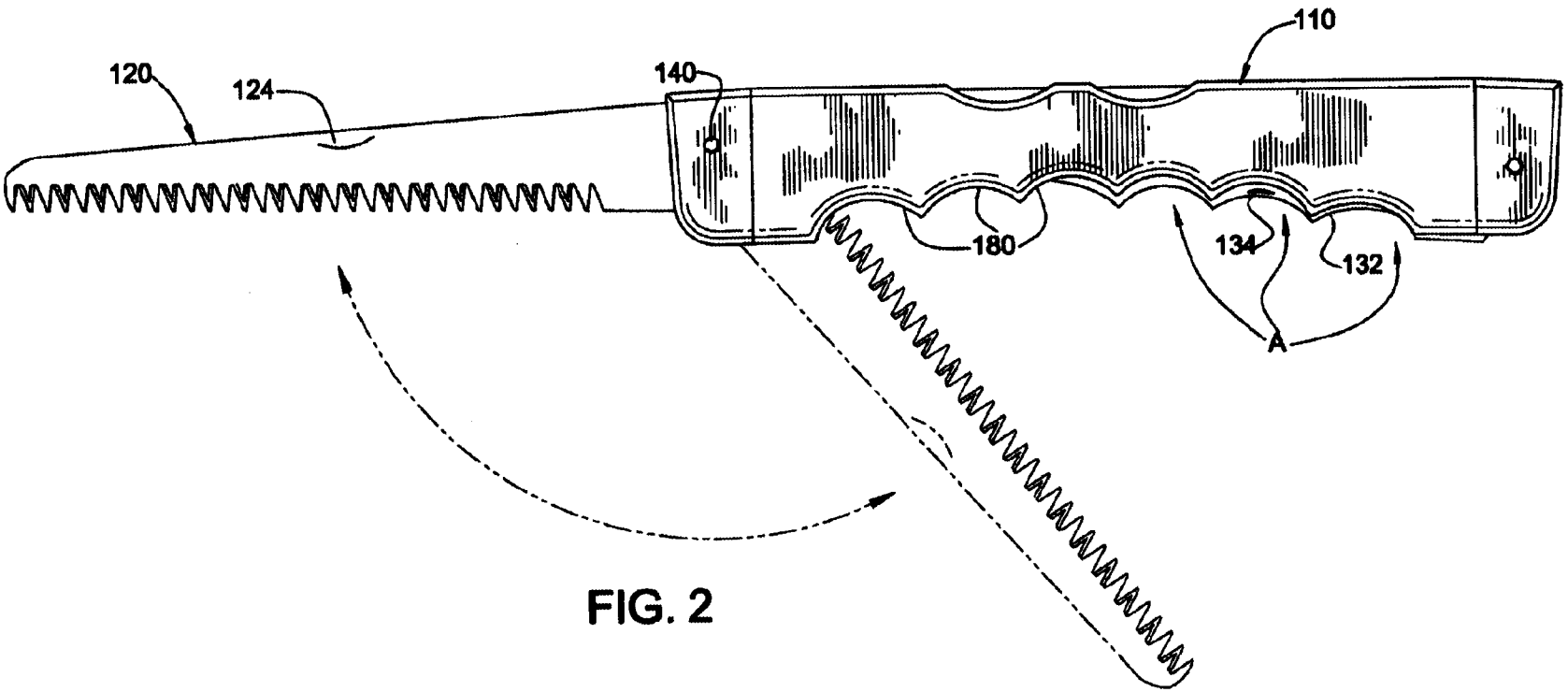
FIG. 2 illustrates the closed position of a first blade, the extended position of a second blade and the closing of the second blade of the knife depicted in FIG. 1.
Figure 3:
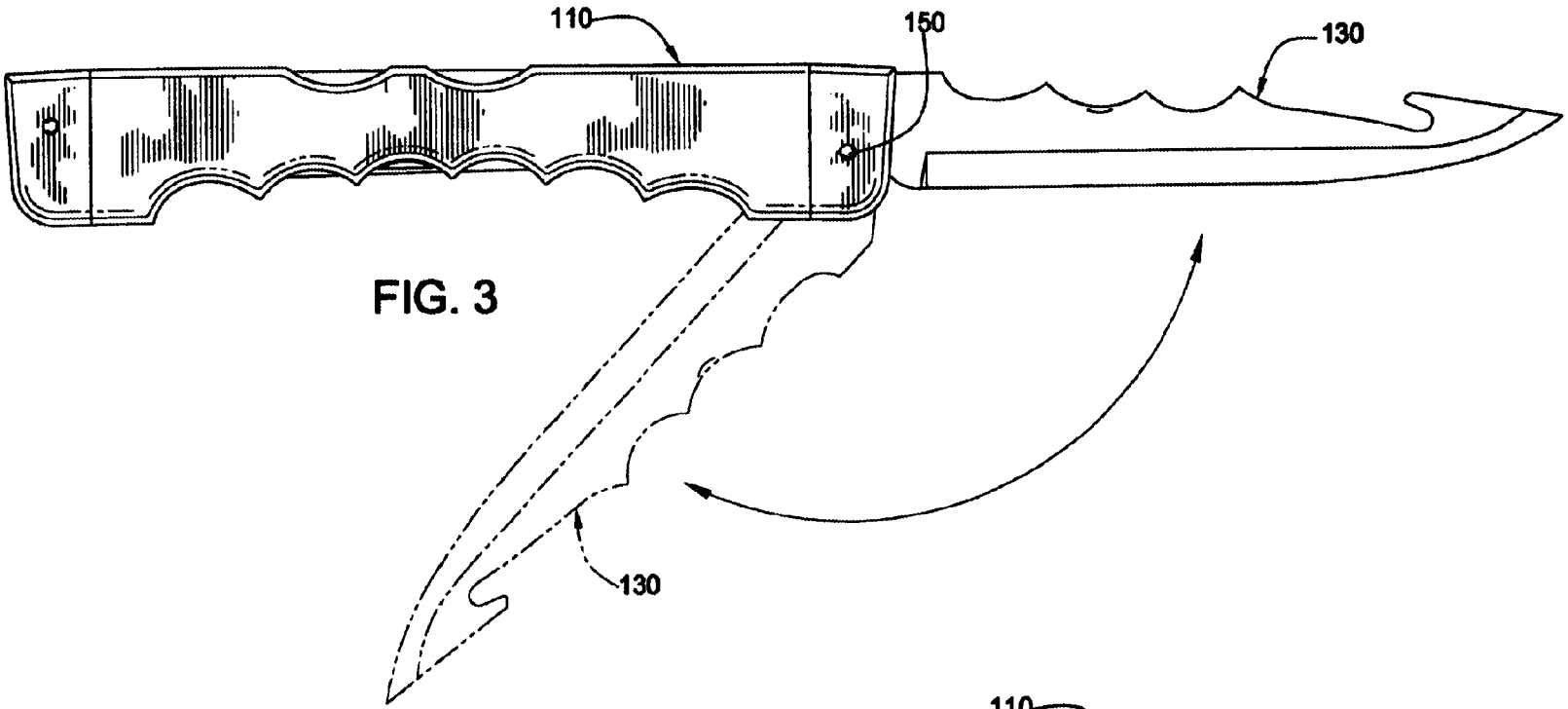
FIG. 3 illustrates the closed position of the second blade, the extended position of the first blade and the closing of the first blade of the knife depicted in FIG. 1.
Figure 4:
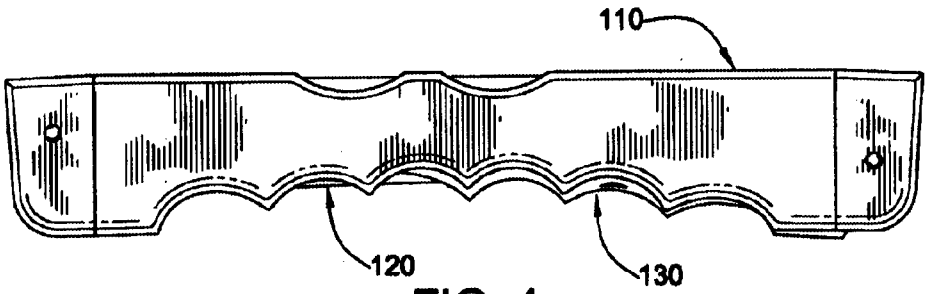
FIG. 4 illustrates both blades in the closed position.

Referring to FIG. 1, there is depicted a folding tool according to a first embodiment of the invention. This knife is a dual folding knife having a blade pivotally connected at each end of the handle. The tool 100 comprises a handle 110, a first blade 130 and a second blade 120. The blades are connected to handle 100 via respective pivot pins 140 and 150. This allows the blades to move from a closed position wherein the blades are located inside handle 110 and an extended position wherein the blades are fully extended from tool 100. FIG. 1 depicts both of the blades in the closed position and both blades in the extended position. The pivotal movement of each blade from its extended position to its closed position is shown in FIGS. 2 and 3. FIG. 4 depicts both blades in the closed position. The first and second blades 120 and 130 are locked in the extended position via any locking system known to those having skill in the art. Upon depression of one of a pair of unlocking members 160, the respective blade is unlocked from its extended position and is thereby allowed to return to a closed position.

In this embodiment, first blade 130 consists of a knife portion 138 on a front side and a hook blade 136 and depressions 132 on the back side of the blade. First blade 130 is also provided with a finger nail slot 134 which is used to pull the first blade from handle 110 when the first blade is in a closed position, as is shown in FIG. 2. Second blade 120 consists of a saw blade 128 and a back side 122. Second blade 120 also has a finger nail slot 124 for pulling the second blade from handle 110 when the second blade is in the closed position.

Handle 110 comprises a series of depressions 180 along an upper side thereof. The depressions fit the fingers of a user. The user grips the tool by placing a bottom side 112 of the tool in the palm of a hand and clasping the fingers around handle 110. The user's fingers will find and fit into depressions 180. When held firmly, finger depressions 180 will prevent tool 100 from slipping from the user's hand during a sawing or cutting action of an opened blade.

Prior art devices generally comprise blades that do not fully fold into the handle of the knife and have a straight backside. Thus when one blade is open and other blades remain closed, the back side of the closed blades protrude from the handle, preventing the user from grasping the handle only or from fitting the fingers into the depressions. The user must grasp the tool via the bottom of the handle and the backsides of the blades which will not adequately prevent the tool from slipping from the user's hand during a heavy cutting operation.

Applicant's invention avoids this difficulty in gripping the handle. As shown in FIGS. 1 and 2, the backside of first blade 130 is provided with at least one depression 132. When first blade is folded into the closed position, as shown in FIGS. 1 and 2, depressions 132 align with handle depressions 180 as shown in area A. Such a design allows for the user to place his fingers in the depressions of handle 110 and the depressions in first blade 130 simultaneously. This allows the user to grasp handle 110 firmly with his fingers even when the first blade is not in use in the closed position. Such provides for a firm grip of the tool for a heavy cutting operation.

Figure 5:
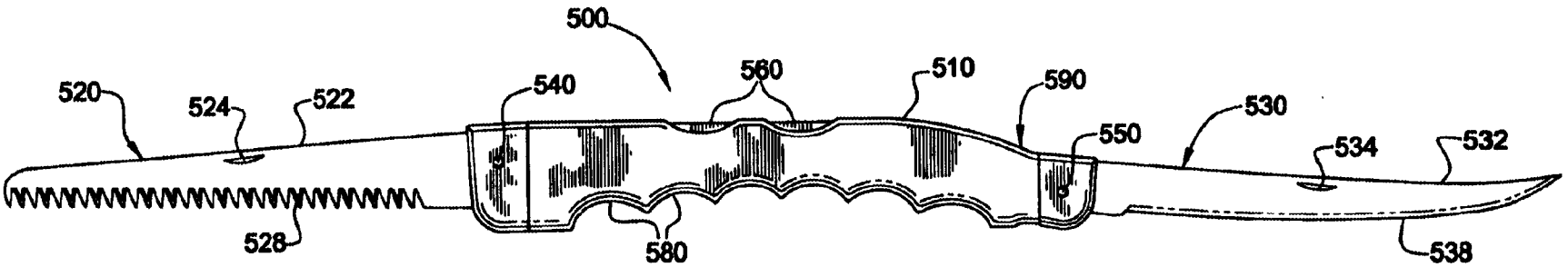
FIG. 5 is a perspective view of a second embodiment of the invention.
Figure 6:
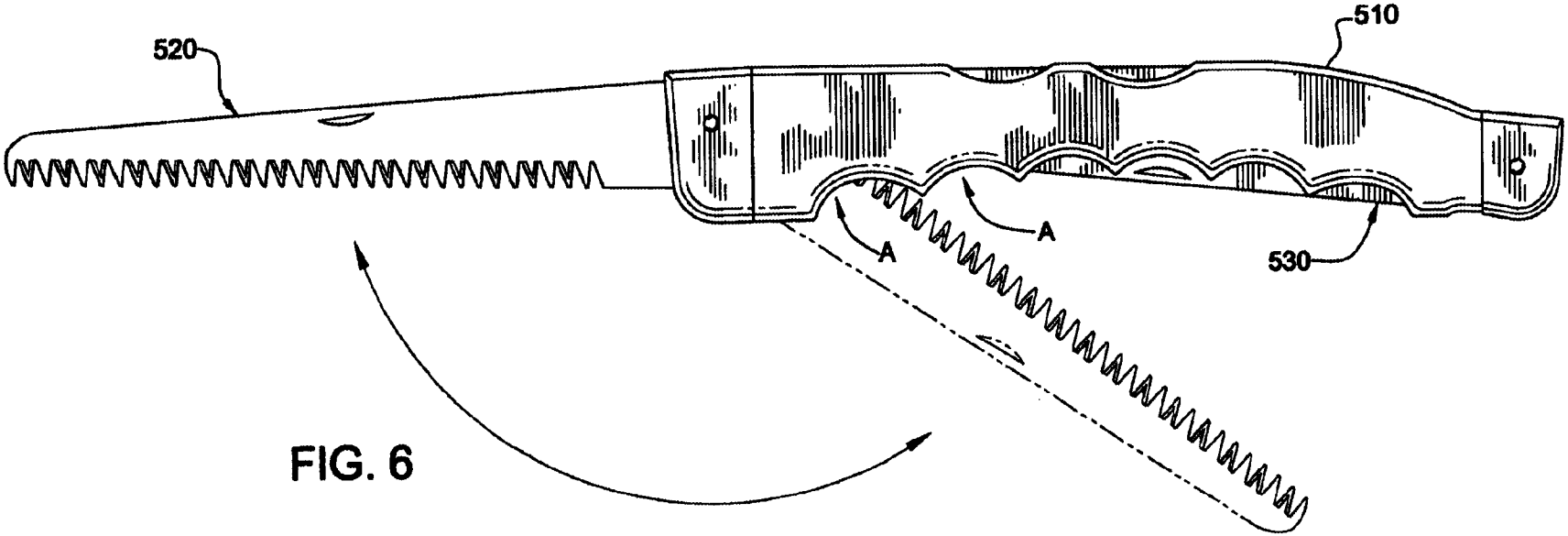
FIG. 6 illustrates the closed position of a first blade, the extended position of a second blade and the closing of a second blade of the knife depicted in FIG. 5.
Figure 7:
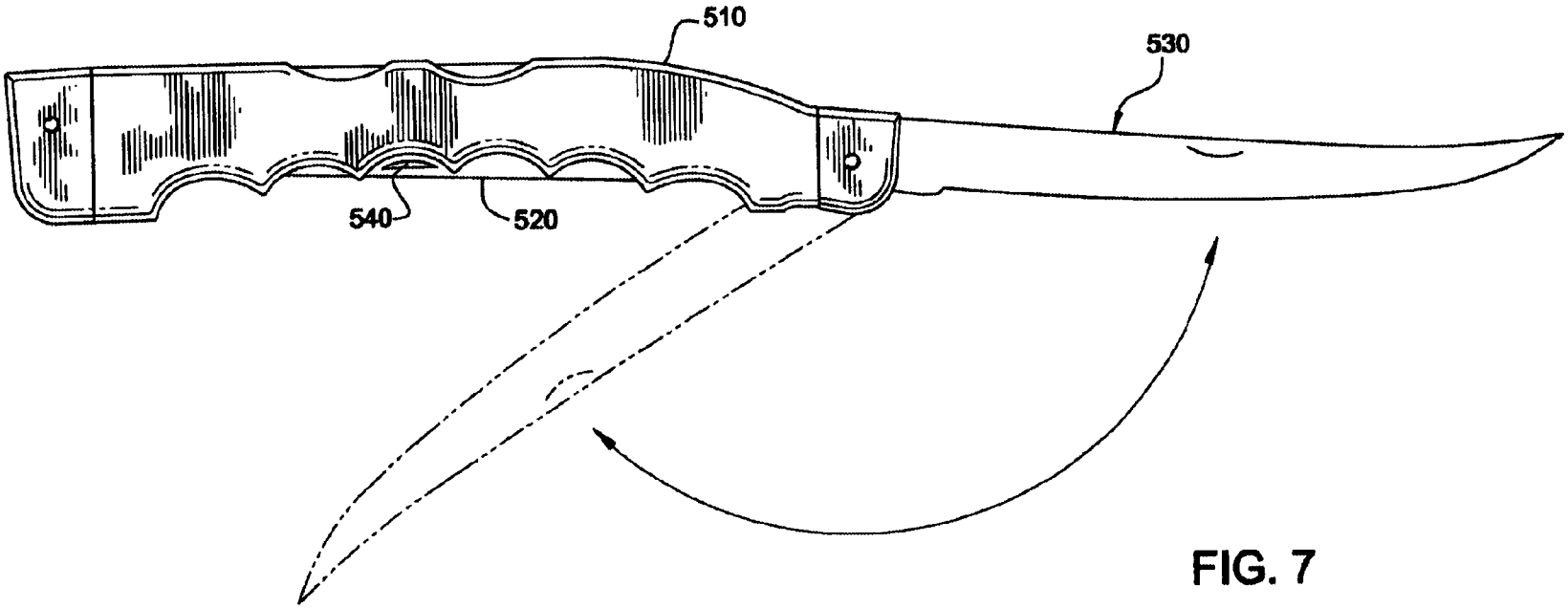
FIG. 7 illustrates the closed position of the second blade, the extended position of the first blade and the closing of the first blade of the knife depicted in FIG. 5.
Figure 8:
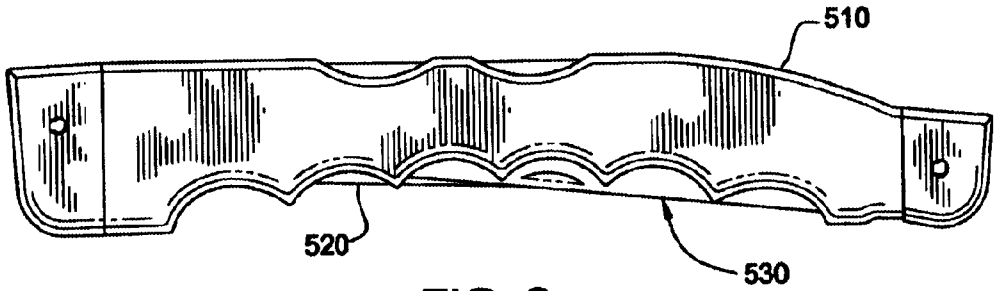
FIG. 8 illustrates both blades in the closed position.

Referring to FIGS. 5–8, there is depicted another folding tool according to a second embodiment of the invention. The tool 500 comprises a handle 510, a first blade 530 and a second blade 520. The blades are connected to handle 500 via respective pivot pins 540 and 550. This allows the blades to move from a closed position wherein the blades are located inside handle 510 and an extended position wherein the blades are fully extended from handle 510. FIG. 5 depicts both blades in the extended position. The pivotal movement of each blade from its extended position to its closed position is shown in FIGS. 6 and 7. FIG. 8 depicts both blades in the closed position. The first and second blades 530 and 520 are locked in the extended position via any locking system known to those having skill in the art. Upon depression of one of a pair of unlocking members 560, the respective blade is unlocked from its extended position and is thereby allowed to return to a closed position.

In this embodiment, first blade 530 consists of a knife portion 538 and a backside 532 opposite the front side. First blade 130 is also provided with a finger nail slot 534 which is used to pull the first blade from handle 510 when the first blade is in a closed position, as is shown in FIG. 6. Second blade 520 consists of a saw blade 528 and a back side 522. Second blade 520 also has a finger nail slot 524 for pulling the second blade from handle 510 when the second blade is in the closed position.

Handle 510 comprises a series of depressions 580 along an upper side thereof. The depressions fit the fingers of a user. The user grips the tool by placing the bottom side of the tool in the palm of a hand and clasping the fingers around handle 510. The user's fingers will find the depressions. When held firmly, the finger depressions will prevent tool 500 from slipping from the user's hand during a sawing or cutting action of an opened blade.

Rather than use depressions in the back side of the first blade, the tool according to this second embodiment gives the user's fingers access to the depressions in handle by moving the location of pivot pin 550 closer to the upper side of handle 510. When first blade 530 is folded in to the closed position, back side 532 of first blade 530 is located beneath the surface of at least one depression 580 which is shown in FIG. 6 at area A. This allows the user's fingers full access to at least one depression 580 without the first blade interfering, and provides the user a firmer grip on the tool during heavy operation.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims. For example, the blades of the tool need not be pivotally connected to opposite ends of the handle, all blades could be connected to one end, some from one end, some from the other or split evenly. Also, the knife need not have only two blades, the knife could have many more blades attached thereto having the properties described herein. A two-blade model is shown by way of example. Further, the specific blade designs used are not limiting, this invention may be used in conjunction with any type of cutting edge without departing from the invention.

What is claimed is:

1. A folding cutting tool comprising:

a handle having a first and second end and an upper side having a plurality of depressions;

a plurality of blades each pivotally connected to the handle at one of the first and second ends and comprising a cutting edge and a back edge opposite the cutting edge, wherein each blade travels between a folded position wherein the cutting edge is retracted inside the handle through an aperture on the upper side and an extended position wherein the cutting edge is outside the handle;

wherein at least one blade has a plurality of depressions on its back edge each depression aligning with a corresponding one of the plurality of depressions on the handle when the at least one blade is in the folded position.

2. The tool as recited in claim 1 wherein first and second blades are connected at the first and second ends, respectively.

3. The tool as recited in claim 1 wherein a first blade is a saw having a plurality of teeth along the cutting edge.

4. The tool as recited in claim 1 wherein a plurality of the depressions extends along the upper side of the handle.

5. The tool as recited in claim 2 wherein the back edge of the second blade has at least one depression that aligns with the at least one depression on the upper side of the handle.

6. The tool as recited in claim 2 wherein the back edge of the second blade has a plurality of depressions each depression aligning with a corresponding one of the plurality of depressions on the upper side of the handle.

7. The tool as recited in claim 2 wherein the second blade has a hook blade on the back edge.

8. The tool as recited in claim 7 wherein the first blade is a saw having a plurality of teeth along the cutting edge.

9. The tool as recited in claim 7 wherein the hook blade folds beneath the upper side of the handle when the second blade is in the folded position.

10. A folding cutting tool comprising:

a handle having a first and second end and an upper side having at least one depression; and a plurality of blades each pivotally connected to the handle at one of the first and second ends and comprising a cutting edge and a back edge opposite the cutting edge, wherein each blade travels between a folded position wherein the cutting edge is retracted inside the handle through an aperture on the upper side and an extended position wherein the cutting edge is outside the handle;

wherein when each blade is in the folded position, a portion of the back edge of said each blade is beneath the surface of one of said at least one depression on the upper side of the handle.

11. The tool as recited in claim 10 wherein first and second blades are connected at the first and second ends, respectively.

12. The tool as recited in claim 10 wherein a first blade is a saw having a plurality of teeth along the cuffing edge.

13. The tool as recited in claim 10 wherein a plurality of the depressions extends along the upper side of the handle.

14. The tool as recited in claim 11 wherein the back edge of each of the first and second blades is beneath a respective one of the at least one depression on the upper edge of the handle when the first and second blades are in respective folded positions.

15. A folding cutting tool comprising:

a handle having a first and second end and an upper side having a plurality of depressions; and a plurality of blades each pivotally connected to the handle at one of the first and second ends and comprising an a cutting edge and a back edge opposite the cutting edge, wherein each blade travels between a folded position wherein the cutting edge is retracted inside the handle through an aperture on the upper side and an extended position wherein the cutting edge is outside the handle;

wherein at least one first blade has a plurality of depressions on its back edge each aligning with one of the plurality of depressions on the handle when the at least one blade is in the folded position and wherein a portion of the back edge of at least one second blade is beneath one of said at least one depression on the upper side of the handle when the at least one second blade is in the folded position.

16. The tool as recited in claim 15 wherein the first and second blades are connected to the first and second ends, respectively.

17. The tool as recited in claim 15 wherein the back edge of each of the at least one first blade has a plurality of depressions that align with a corresponding plurality of depressions on the upper side of the handle.

18. The tool as recited in claim 15 wherein one of the at least one second blade is a saw having teeth extending along the cutting edge.

19. The tool as recited in claim 15 wherein one of the at least one second blade has a hook blade on the back side thereof.

20. The tool as recited in claim 19 wherein the hook blade is beneath the surface of at least one of the plurality of depressions on the upper side of the handle when the one of the at least one second blade is in the folded position.

21. The tool as recited in claim 1 wherein the plurality of depressions in the handle extends in side-by-side relation over the length of the upper side.

22. The tool as recited in claim 15 wherein the plurality of depressions in the handle extends in side-by-side relation over the length of the upper side.

* * * * *

UNITED STATES PATENT AND TRADEMARK OFFICE

CERTIFICATE OF CORRECTION

PATENT NO. : 6,715,209 B2
DATED : April 6, 2004
INVENTOR(S) : Taylor et al.

It is certified that error appears in the above-identified patent and that said Letters Patent is hereby corrected as shown below:

Column 4, lines 41-45, Column 5, lines 12-16 and Column 6, lines 9-12,
Please delete claims 4, 5, 14 and 17.

Signed and Sealed this

First Day of June, 2004

JON W. DUDAS
*Acting Director of the United States Patent and Trademark Office*